US009157269B2

(12) United States Patent
Brown

(10) Patent No.: US 9,157,269 B2
(45) Date of Patent: Oct. 13, 2015

(54) AUTOMATIC PET DOOR CONTROLLED BY SMART PHONE

(71) Applicant: Richard Brown, Kernersville, NC (US)

(72) Inventor: Richard Brown, Kernersville, NC (US)

( * ) Notice: Subject to any disclaimer, the term of this patent is extended or adjusted under 35 U.S.C. 154(b) by 0 days.

(21) Appl. No.: 14/038,246

(22) Filed: Sep. 26, 2013

(65) Prior Publication Data

US 2014/0090299 A1 Apr. 3, 2014

Related U.S. Application Data

(60) Provisional application No. 61/709,236, filed on Oct. 3, 2012.

(51) Int. Cl.
*E06B 7/28* (2006.01)
*E06B 7/32* (2006.01)

(52) U.S. Cl.
CPC ..... *E06B 7/32* (2013.01)

(58) Field of Classification Search
CPC ..... E06B 7/32
USPC ..... 49/168, 169, 25, 29; 119/484, 501, 165; 160/180
See application file for complete search history.

(56) References Cited

U.S. PATENT DOCUMENTS 4,322,913 A * 4/1982 Himmer ..... 49/168
5,072,544 A * 12/1991 Breck, Jr. ..... 49/264
5,992,096 A * 11/1999 De La Cerda et al. ..... 49/169
6,297,739 B1 * 10/2001 Small ..... 340/573.3
6,782,847 B1 * 8/2004 Shemesh et al. ..... 119/718
7,634,975 B2 * 12/2009 Kates ..... 119/712
7,764,191 B2 * 7/2010 Hall et al. ..... 340/12.51
7,765,955 B2 * 8/2010 Brooks et al. ..... 119/484
8,240,085 B2 * 8/2012 Hill ..... 49/169
8,302,348 B2 * 11/2012 Noyes ..... 49/169
8,464,663 B2 * 6/2013 Kodat ..... 119/484
8,539,715 B2 * 9/2013 Hill ..... 49/169
8,595,976 B1 * 12/2013 Solowiej et al. ..... 49/169
8,624,743 B2 * 1/2014 Langer et al. ..... 340/573.3
2002/0015418 A1 * 2/2002 Uemura ..... 370/466
2004/0189477 A1 * 9/2004 Hisano ..... 340/573.3
2004/0194714 A1 * 10/2004 Lee ..... 119/54
2004/0206310 A1 * 10/2004 Hutchins ..... 119/720
2005/0099291 A1 * 5/2005 Landau ..... 340/539.13
2005/0217606 A1 * 10/2005 Lee et al. ..... 119/720
2005/0217607 A1 * 10/2005 Light et al. ..... 119/721
2005/0257752 A1 * 11/2005 Langer ..... 119/712
2006/0011144 A1 † 1/2006 Kates
2006/0011146 A1 † 1/2006 Kates
2006/0196445 A1 † 9/2006 Kates
2006/0196446 A1 † 9/2006 Kates
2006/0201433 A1 † 9/2006 Kates
2006/0201436 A1 † 9/2006 Kates
2007/0056526 A1 * 3/2007 Gianladis et al. ..... 119/721
2007/0175097 A1 * 8/2007 Thorne et al. ..... 49/169

(Continued)

FOREIGN PATENT DOCUMENTS

WO 2007/039708 A2 † 4/2007

*Primary Examiner* — Jerry Redman
(74) *Attorney, Agent, or Firm* — Ben Schroeder Law PLLC

(57) ABSTRACT

The present invention relates to a pet door system that has one or more open modes throughout a day wherein a pet can transverse the door for limited duration of time. In one variation, the open mode of the door may terminate upon passage by the pet and the pet may traverse the door at the next open mode. In one variation, the pet door system is controlled by a smart phone and an associated smart phone application.

16 Claims, 4 Drawing Sheets

(56) References Cited

U.S. PATENT DOCUMENTS

| | | | | |
|---|---|---|---|---|
| 2007/0204803 | A1* | 9/2007 | Ramsay | 119/720 |
| 2007/0234643 | A1* | 10/2007 | Siegal et al. | 49/360 |
| 2008/0036594 | A1† | 2/2008 | Kates | |
| 2008/0036611 | A1 | 2/2008 | Noblitt | |
| 2008/0056459 | A1* | 3/2008 | Vallier et al. | 379/88.12 |
| 2008/0216765 | A1* | 9/2008 | Kates | 119/712 |
| 2008/0223300 | A1* | 9/2008 | Kates | 119/72 |
| 2008/0282988 | A1* | 11/2008 | Bloksberg | 119/51.02 |
| 2008/0314335 | A1 | 12/2008 | Kates | |
| 2009/0031966 | A1* | 2/2009 | Kates | 119/719 |
| 2012/0025949 | A1* | 2/2012 | Reed | 340/5.7 |
| 2013/0305609 | A1* | 11/2013 | Graves | 49/168 |

* cited by examiner
† cited by third party

AUTOMATIC PET DOOR CONTROLLED BY SMART PHONE

The present application claims the benefit of and priority under 35 USC 119(e) to U.S. Provisional Application No. 61/709,236 filed Oct. 3, 2012, the entire contents of which are incorporated by reference.

FIELD OF THE INVENTION

The present invention relates to a pet door system that is fully automatic, programmable, and electronic. In one embodiment, the pet door system does not require human or pet cooperation to be fully functional but can be pre-programmed by use of a smart phone or a computer. In one embodiment, the design of the pet door incorporates software that allows control by smart phone technology applications and in an embodiment, that allow for easy remote programming or override functions from anywhere in the world.

BACKGROUND OF THE INVENTION

Pet owners find that it is a nuisance to continually let a pet in and out of the house and frequently provide a door for the pet so the pet can come and go at will. Frequently such doors take the form of a series of triangular flexible members arranged to form an iris. A pet can easily push its way through the center of such an iris and it will spring back to keep out the weather.

One difficulty with such pet doors is that stray pets or other animals will frequently follow the owner's pet into the house or alternatively, come in the house at some opportune time. Accordingly, it would be highly desirable to provide a device which would allow the owner's pet to come and go but which would prevent stray pets and other animals from entering the house.

In accordance with the present invention, a very simple and inexpensive device is desired wherein the owner's pet can come and go from the house, while stray pets and other animals are kept out of the house.

BRIEF SUMMARY OF THE INVENTION

The present invention relates to a pet door that is fully automatic, programmable, and electronic. In one embodiment, the pet door does not require human or pet cooperation to be fully functional but can be pre-programmed by use of a smart phone or a computer. This design of the pet door incorporates software that allows control by smart phone technology applications and in an embodiment, that allow for easy remote programming or override functions from anywhere in the world.

In an embodiment, the door can be programmed so that it can be accessed by a pet one or more times a day (i.e., when it is in an "open mode"). In one embodiment, the pet door cannot be opened at other times of the day when it is not in an "open mode".

DETAILED DESCRIPTION OF THE INVENTION

Figure 1:
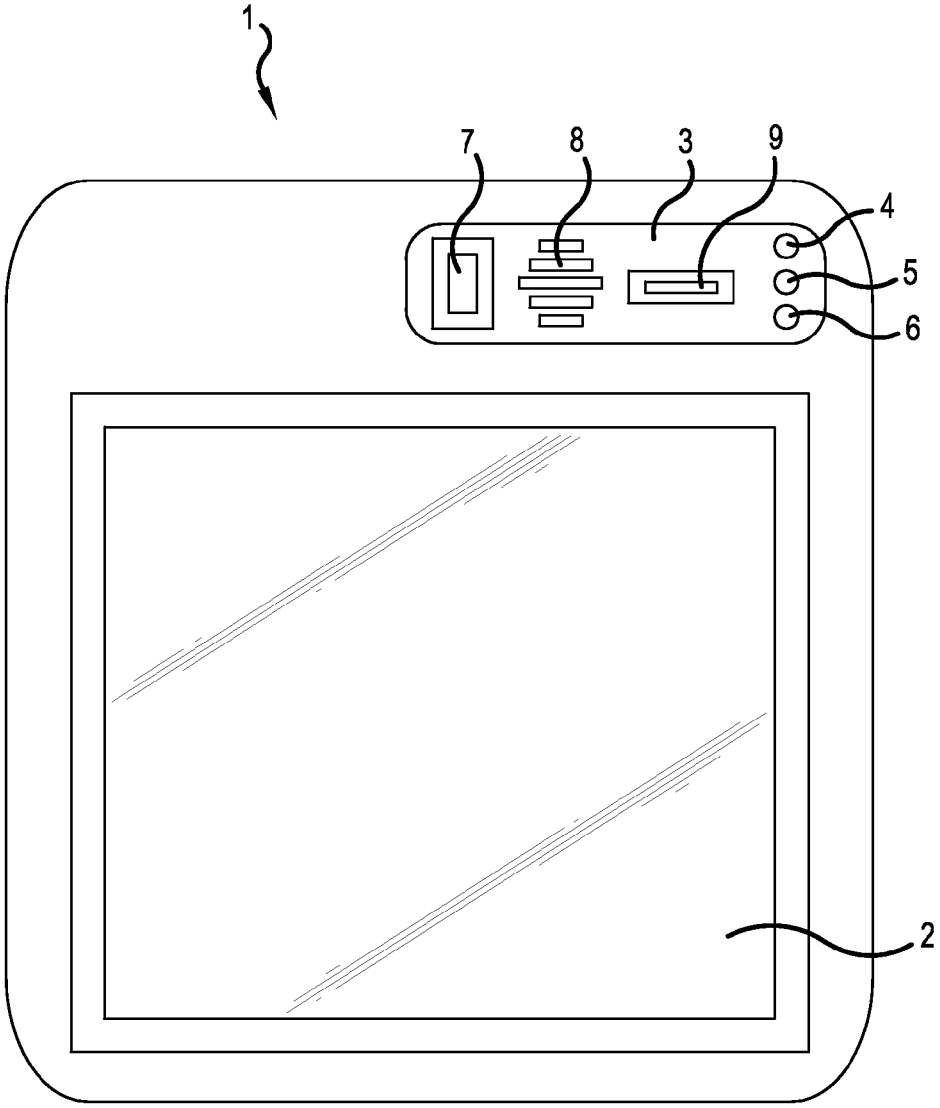
FIG. 1 shows a front view of the pet door, which can be controlled by one or more applications on smart phone or alternatively by a remote controlled device.

The present invention relates to a pet door that is fully automatic, programmable, and electronic. In one embodiment, the pet door does not require human or pet cooperation to be fully functional but can be pre-programmed by use of a smart phone or a computer. This design of the pet door incorporates smart phone technology applications that allow for easy remote programming or override functions from anywhere in the world.

In an embodiment, the pet door can be used by cats (both domestic and non-domestic dogs (both domestic and non-domestic), rabbits, ferrets, or other animal that can be trained to use a pet door. In an embodiment, the pet door can be used at a residence or alternatively at another location. In one embodiment, the door can be used for animals at a zoo.

In one embodiment, the pet door does not utilize a "collar" or kind of proximity sensing device to allow the door to open. Rather in this embodiment, the door can be preprogrammed to be in an "open mode" for one or more times a day that allows egress and ingress of the pet. In an embodiment, the door can be preprogrammed by use of a smart cell phone to be in an "open mode" one or more times for up to 50 or more times a day. The door may be pre-programmed to be in "open mode" for any length of time. The length of time that the door is in "open mode" should be sufficient so that a pet has adequate time to go in and out of the door at those times but not so long as to permit the entry and exit by other pets and/or stray animals. Thus, in an embodiment, the door may be in "open mode" for times between 5 seconds and five minutes. In one embodiment, the length of time the door is in open mode can be programmed to be any length of time. When a pet is young and/or is an active adult, the time period for egress and ingress of the pet may be smaller than an older pet that cannot get to the pet door as quickly. Moreover, both very young pets and old pets may need to have more "open modes" during the day than adult pets as they may need to go to the bathroom more frequently. Likewise, the duration and the frequency of the "open mode" can be adjusted according to the season of the year or to the weather forecast. However, it should be noted that because the pet door is fully programmable, both the duration of the "open mode" and its frequency in a day can be modified to the needs of any pet.

In one embodiment, at the moment that the door commences the "open mode", the door system emits a pleasant two tone whistle inside and outside that alerts the animal to the fact that access to the door is now available. The whistle can be made to be any frequency range. In one embodiment, the frequency may be high or low so that it is not audible to the human ear but is audible to pets and/or animals (for example, when the door is used in a zoo setting, the frequency may be low so that it can be heard by elephants but not by many other animals, such as humans). It should be understood that other tones or sounds can be utilized to indicate when the "open mode" commences. In an embodiment, the door system may have one sound that indicates to the pet and/or animal that the "open mode" has commenced and a different sound that indicates to the animal that the door is no longer in the "open mode". In this variation, the pet will know when the door is no longer available to be transgressed. In a variation, additional tones may be used to alert the animal to the fact that the "open mode" of the door may be soon terminating alerting the animal to the fact that he/she may have to hurry to enter or exit the house (or in the case of a zoo or other place that has animals, to enter or exit from inside to outside or to enter or exit from one room to another). In an embodiment, the notification whistle serves to very quickly train the pets to respond and take advantage of the opportunity to go in our out as the need may be.

The smart phone technology is suitable for Android phones and iPhones alike. The smart phone applications allow for easy programming of the door. In one embodiment, the application on the smart phone alerts the human to impending severe weather at their home address. The severe weather alert may be part of the application that also controls the pet door and alternatively, may be part of a separate independent application that is linked to the application that controls the pet door. Accordingly, in one embodiment, the human can access the pet door and open or close it as needed from their smart phone. For example, the pet owner can control the pet door from the owner's office, from the owner's living room, or from anywhere in the world. In one embodiment, the door system can also be preprogrammed so that the door remains in "open mode". In a variation, the pet door may also incorporate a manual override button in the door housing that allows the door to remain in the "open mode". Preferably, the manual override button will be in a direction so that it can be easily accessed by the pet's owner but not by other individuals. In one embodiment, there may be a PIN code that may need to be entered to either program the door system or to override the pet door to allow it to remain in the "open mode". In one embodiment, the door can also be programmed via a USB cable from a laptop. Alternatively, the door may have wireless network adaptor technology associated with it so that an individual can control it remotely (for example, via a desktop that has a router).

In an embodiment, the smart phone application may also be able to provide the owner with information as it relates to the pet. For example, the smart phone application may alert the owner not only to the time but also as to the direction that the pet was travelling when the pet last entered or exited through the pet door. For example, if severe weather is approaching the location of the residence that has the pet door system, the owner can appropriately adjust the pet door system so as to create an open mode or to shut the system down so that the pet goes or remains indoors. Other information that may be provided on the smart phone includes the charge level of the battery.

In one embodiment, the locking mechanism simply engages or disengages to release the door. In an embodiment, the door may be made of a hard clear plastic flap to allow the animal to utilize the door. Alternatively, other materials may be used for the door, such as metal, hard rubber, or any other material that is suitable for pet doors. In an embodiment, the door system is designed so as to be very energy efficient and may comprise insulation or other materials that render the door energy efficient (so that cold air does not easily escape a house in summer nor hot air in the winter). In an embodiment, the flap may be dynamic so that it raises and lowers to allow passage of the pet/animal. Alternatively, the flap may not be dynamic in that it does not raise or lower, meaning the pet has to use its energy to transgress the door.

In one embodiment, the pet door utilizes a rechargeable Lithium battery that incorporates a battery status indicator on the housing of the door. There may be one or a plurality of lights that will indicate the charged status of the battery. In one embodiment, the battery may be charged by plugging it into an outlet. Alternatively, the battery may be charged by solar energy. In a variation, the battery may also be charged by converting the kinetic energy of the pet transgressing the door to charging, the battery. In one embodiment, the door may be part of a kit that comprises at least two batteries so that one battery can be charging while the other is present in the door system. Alternatively, it is contemplated and therefore within the scope of the invention that the battery can be charged while it is part of the door system.

In a variation, a smart charger may be used so as to not cause any damage to the battery. In an embodiment, the program memory may be stored on a simple flash drive to allow for retention of the program in the event of total battery failure or drainage of the battery. In one variation, the door system may have an USB port, which allows for insertion of the flash drive.

In one embodiment, to further prevent the ingress and egress of other animals/pets, the door may in addition to any of the above features also have RFID technology associated with it. Accordingly, in this embodiment, not only does the pet have to transgress the door when it is in the "open mode", but the pet also has to have a radiofrequency chip associated with it that allows the pet passage through the door. Because other animals lack this radiofrequency chip, other animals would not be able to pass through the door. U.S. Pat. No. 8,240,085, which explains this FFID technology, is herein incorporated by reference in its entirety. Other means of preventing the ingress and egress of other animals/pets may be used in conjunction with the present invention such as the magnetic device of U.S. Pat. No. 4,022,263, or the electronic transmitter of U.S. Pat. No. 7,921,811, both of which are herein incorporated by reference in their entireties.

One aspect of the invention is shown in FIG. 1. In FIG. 1, the door system 1 comprises a door 2 that allows the passage of an animal. There is a CPU system 3 that comprises a battery (not shown) that also comprises a series of lights 4, 5, and 6 that may indicate the charged status of the battery. In one embodiment, these lights may be colored. For example, light 4 may be green, light 5 may be yellow and light 6 may be red. When the battery is highly charged, the green light may be illuminated. As the charged status of the battery begins to drain, the yellow light 5 may illuminate with the green light 4 also being illuminated until the charged status is at the half-way point, wherein only the yellow light 5 is illuminated. As the battery status continues to drain the red light 6 may become illuminated with the yellow light 5 also illuminated. As the charge status of the battery continues to be depleted, the yellow light 5 will no off leaving only the red light 6 illuminated. Adjacent of the lights 4, 5, 6 are an USB port 9 that allows the battery to be charged. This USB port 9 also allows the loading of the program onto the CPU 3 from a flash drive should the program ever need to be re-loaded. Speaker 8 amplifies the whistles so that it can be heard by the animal (e.g., a cat or a dog) letting the animal know that the door is in the "open mode", allowing the animal ingress and egress through the door. Override button 7 will allow the home owner access to override the preprogrammed aspect of the door system, allowing the owner to keep the door in a permanent "open mode". In an embodiment, the override button may toggle from different states, for example, from the "open mode" to a closed mode (wherein the animal is unable to pass through the door). The closed mode may be used when the animal is indoors and the owner knows that severe weather is coming. Accordingly, the animal owner may not want the pet to go outdoors at this time and thus, keep the door in the closed mode.

In an embodiment, there may be other features associated With the door system 1, such as a light or another device (not shown in FIG. 1) that indicates the direction that the door opened providing the owner of the animal with information as to whether the animal is inside or outside. Thus, when the owner is unable to and the animal, the owner will know where to look for the animal.

In another embodiment, the door system 1 may have a door 2 that only allows passage in one direction. Once the animal has passed through the door the direction that the door can be transgressed is reversed allowing the animal to only pass through the door from the other direction. This embodiment might be particularly advantageous to those pet/animal owners that have only one pet/animal. In this variation, the pet/animal can go outside when the door is in the "open mode" and when the door system is next in the "open mode" (where the animal is alerted to the open mode by a sound), the animal can pass from outside to inside. No other animals can follow because the door can only be transgressed in the direction from inside the house to outside.

Figure 2:
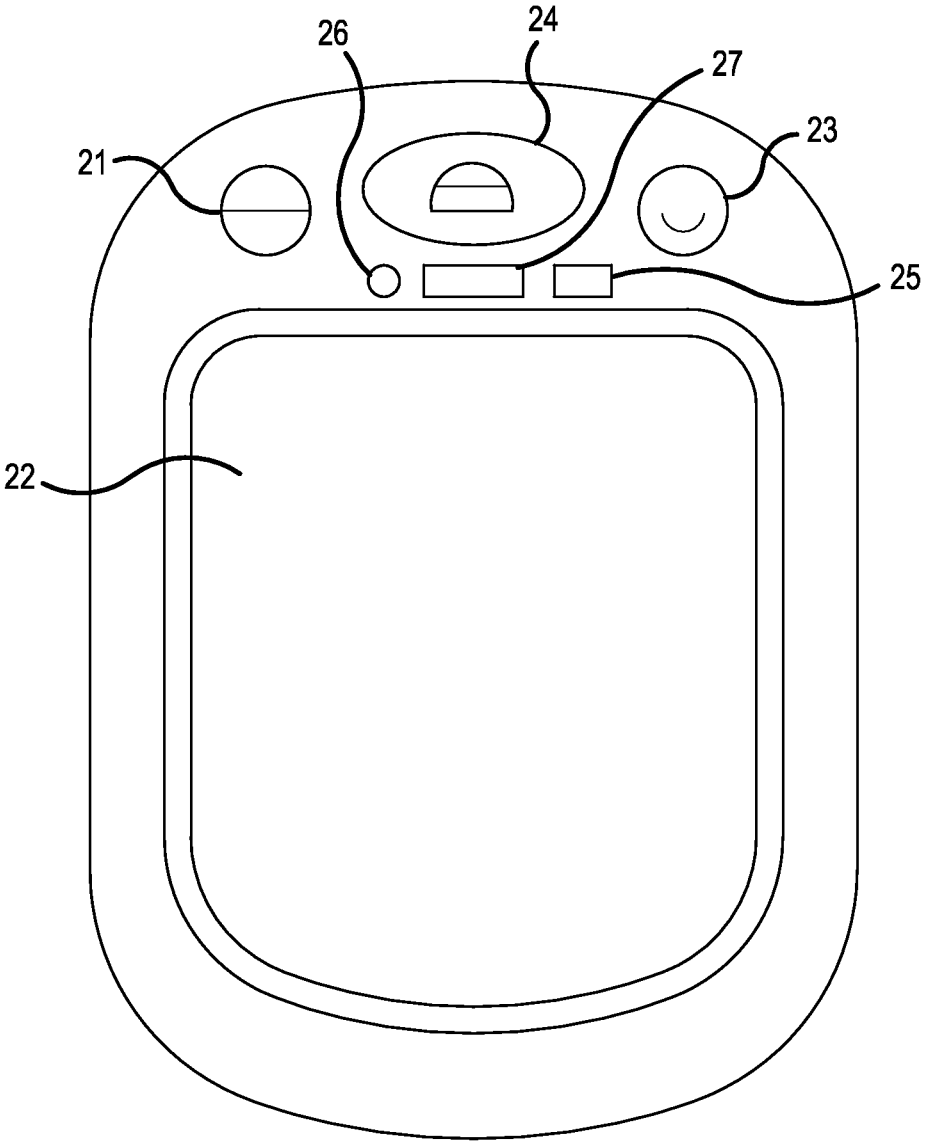
FIG. 2 shows a front view of a different embodiment of the pet door, which can be controlled by one or more applications on a smart phone or alternatively by a remote controlled device.

FIG. 2 shows an embodiment of the pet door of the present invention wherein the shape of the door is slightly different from that shown in FIG. 1. In FIG. 2, there exists a USB Charging Port 21, a clear window or lens 22, a power button 23, a manual electric lock button 24, a battery charge level icon 25, a WIFI signal strength indicator light 26, and a Dual LED multi-color level indicator for battery and WIFI 27.

In one embodiment, the pet door may be charged in a manner similar to a smart phone wherein a USB charging port 21 is used to charge the device. It can be plugged into a computer for charging or alternatively, it can be charged by a wall outlet. Alternatively, the USB port may be able to be connected to a computer via a USB cord to provide a pet owner with information that comes from the pet door (alternatively, this may be done in a wireless manner). For example, the information may be when the pet last used the door.

In one embodiment, the pet door may contain a clear window or lens 22. The window or lens may be made of plastic, of Plexiglas, of glass (such as laminated glass), or of some other suitable material. Alternatively, the window or lens may be opaque or partially opaque so that one cannot see through the pet door. In one embodiment, the window or lens may be a one-way window or lens so that one can see through it from one direction but cannot see through it from the other direction. In one variation, the lens or window 22 will be oriented so that a one can see through the pet door in a direction from the inside of the house to the outside of the house, not the other way.

Figure 3:
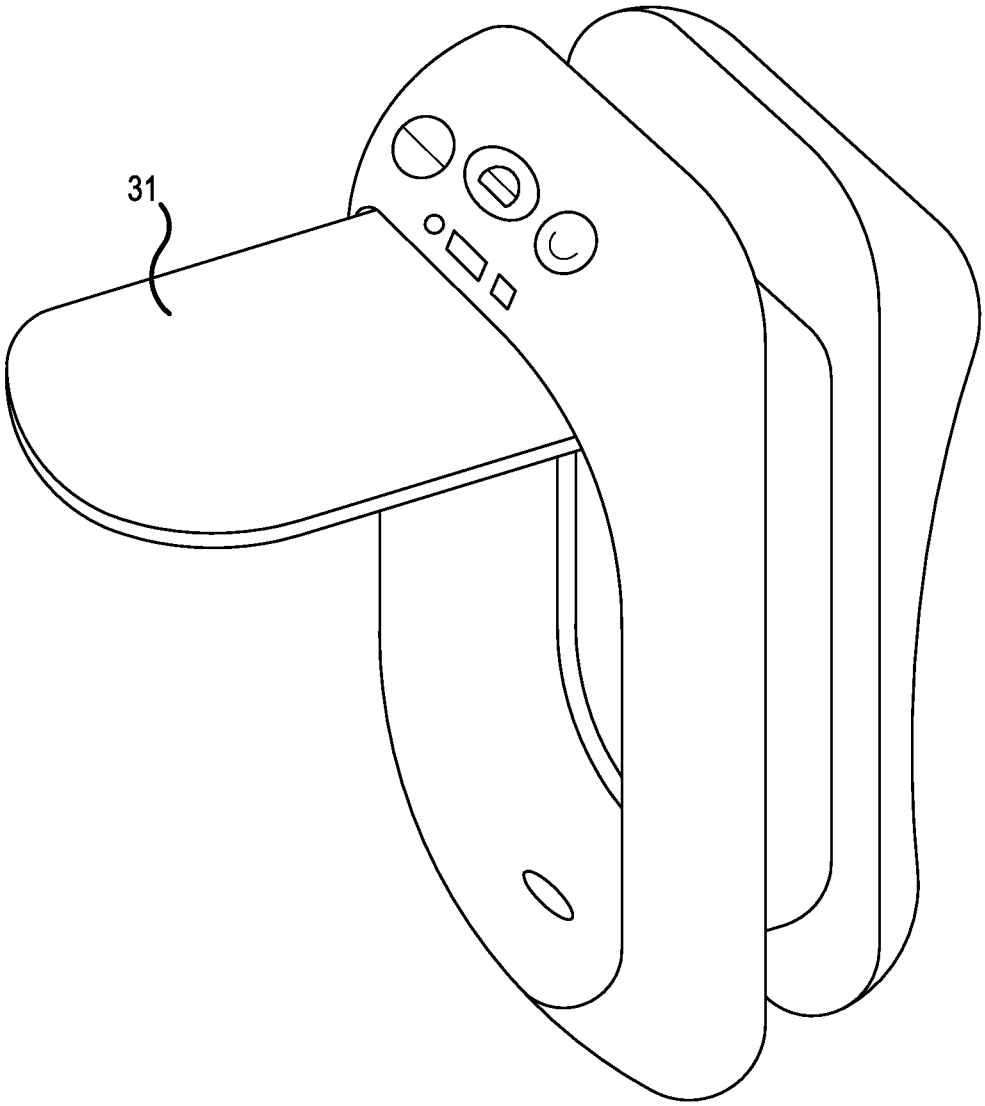
FIG. 3 shows a perspective view of an embodiment of the pet door with the pet door open.
Figure 4:
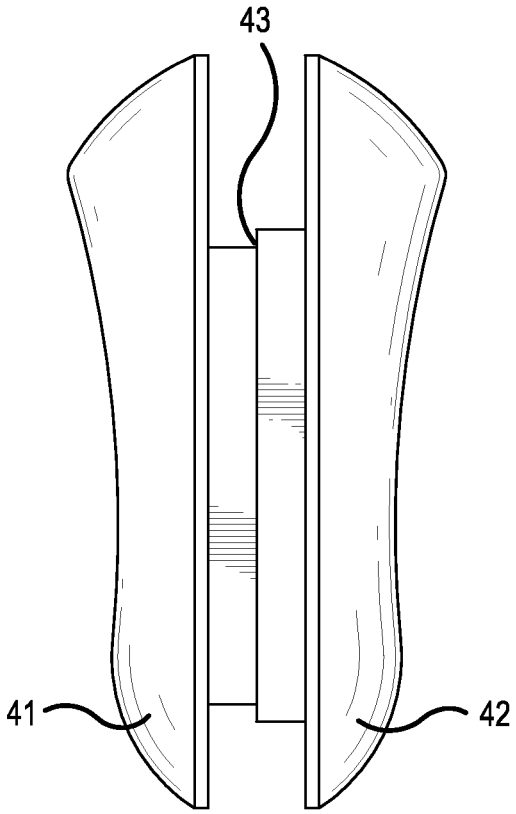
FIG. 4 shows a side view of a pet door.

FIG. 3 shows a perspective view of an embodiment of the present invention wherein the window or lens 22 is in an open position 31. The lens or window may be designed so that it can open in either direction (either to the inside of a house or to the outside of the house). Alternatively, the lens or window may be programmed so that it only opens in one direction (such as to the inside of the house). In a variation, it may be programmed so that the door will only open in alternate directions or it may be programmed so that it opens twice in one direction and then twice in the opposite direction. This programming ability may be used by a home owner to keep vermin out of the abode. FIG. 4 shows a side view of an embodiment of the present invention. In this view, the pet door is oriented so that there is an inside part 41, and outside part 42, and a middle part 43. In one embodiment, the inside part 41 is facing the inside of the house and has the power button on it as well as a USB port. The inside part 41 may also have the other parts as described in FIGS. 1 and 2 on it. Alternatively, some of the elements that are described in FIGS. 1 and 2 may be on the outside part 42. In some embodiments, one or More of the elements that are described with reference to FIGS. 1 and 2 may be on the inside and some may be on the outside. Finally, in certain embodiments, there may be the same element on the inside and the outside. For example, a power button (or a USB port, or any element) may be present on both the inside part 41 and the outside part 42 of the pet door. As shown in FIG. 4, the middle part 43 of the pet door is smaller in height (and may be smaller length—not shown) than the inside part 41 and the outside part 42. This facilitates the installation of the pet door to the door or wall where the pet door is to be installed (and provides a finished look to the pet door).

Accordingly, in an embodiment, the present invention relates to a pet door system that comprises a pet door, a central processing, unit, and at least one speaker, wherein the central processing, unit is programmed to control the pet door system so that passage through the pet door by a pet can only be made during one or more open modes, with each open mode allowing passage by the pet through the pet door for a limited duration of time.

In a variation, the speaker emits at least one sound that alerts the pet that passage through the pet door is possible. In a variation, the sound is at least one of a whistle and/or chime. In a variation, the sound is of a frequency that cannot be heard by humans. Alternatively, the sound may be of a frequency that can be heard by humans. In one embodiment, the speaker sounds and/or the speaker volume can be controlled remotely from an application that is present on a smart phone.

In an embodiment, the pet door system has an open mode wherein the limited duration of time is less than about one minute. Alternatively, the limited duration of time is less than about half a minute. Alternatively, the limited duration of time is less than about fifteen seconds.

In an embodiment, a plurality of open modes are available per day. In a variation, the number of open modes may be between about 3 and 20, alternatively between about 6 and 15, alternatively between about 10 and 12. In a variation, the plurality of open modes may be spread equally throughout the day. Alternatively, the plurality of open modes may occur mainly or completely during the day (i.e., when sunlight is present). In an embodiment, the application that can be accessed by a smart phone may have a time of day function and alternatively and/or additionally may have a reminder function that lets the owner know that the pet door may need to be programmed.

In an embodiment, once a pet has passed through the pet door during an open mode, the pet door can no longer be transgressed by the pet until the next open mode.

In an embodiment the central processing unit may be operationally linked to a smart phone or a computer, wherein the computer or the smart phone have an application that allows programming of software associated with the central processing unit. In a variation, a smart phone application controls the programming of software associated with the central processing unit.

In an embodiment, the pet door system further comprises a battery which powers the central processing unit. In a variation, the charge on the battery is indicated by the illumination of one or more lights. In a variation, at least three lights are present that indicate the charge on the battery. In a variation, these three lights may have different colors allowing a human to easily discern the charge on the battery.

In an embodiment, the pet door system may further comprise an override button that allows override of the programmed pet door system.

In one embodiment, the pet door system is of a size that accommodates passage by a cat. In an alternate embodiment, the pet door system is of a size that accommodates passage by a dog. Accordingly, the pet door system can allow passage of animals that are the size of small kittens to very large dogs such as Mastiffs or Great Danes.

In an embodiment, the pet door system may further comprise a light that indicates a direction in which passage by the pet was made. In a variation, the color of the light may change depending on how the pet door was transgressed. For example, if the pet is outside, a green light may be illuminated and if the pet is inside, a blue light may be illuminated. Alternatively and/or additionally, the pet door may have a camera associated with it that can be accessed and controlled remotely via a smart phone application so that one can View the pet to ascertain its location.

In an embodiment, the present invention relates to a pet door system that comprises a pet door, a central processing unit, at least one speaker, at least one battery charge indicator light, and an override button: wherein the central processing unit is programmed to control the pet door system so that passage through the pet door by a pet can only be made during one or more open modes, with each open mode allowing passage by the pet through the pet door for a limited duration of time, said speaker emitting at least one sound each time the one or more open modes are available to the pet, said override button allowing the override of the programmed control of the pet door.

In a variation, the central processing unit may be operationally linked to a smart phone or a computer, wherein the computer or the smart phone have an application that allows programming of the central processing unit to control the timing and the duration of the one or more open modes. In a variation, the central processing unit of the pet door system is controlled by a smart phone application. In an embodiment, the smart phone application alerts a pet owner that severe weather is soon coming to the pet door system location alerting the owner that he/she may want to change the program of the pet door system.

It is to be understood that the above is merely a description of the preferred embodiment and that various modifications could be made by one skilled in the art without departing from the concept of the invention disclosed therein. It is contemplated and therefore within the scope of the present invention that any compatible feature that is discussed above can be combined with any other feature. When ranges are discussed, it should be understood that any value within said range is contemplated as an endpoint. The scope of protection to be afforded is to be determined by the claims which follow and the breadth of interpretation which the law allows. It should be understood that the present invention contemplates product, system, and method claims.

I claim:

1. A pet door system that comprises a pet door, a central processing unit, and at least one speaker, wherein the central processing unit is programmed to control the pet door system so that passage through the pet door by a pet can only be made during one or more open modes, with each open mode allowing passage by the pet through the pet door for a limited duration of time wherein the limited duration of time is less than about one minute and wherein the pet door further comprises a light that indicates a direction in which passage by the pet was made.

2. The pet door system of claim 1, wherein the speaker emits a sound that alerts the pet that passage through the pet door is possible.

3. The pet door system of claim 2, wherein the sound is at least one of a whistle or chime.

4. The pet door system of claim 1, wherein the limited duration of time is less than about half a minute.

5. The pet door system of claim 1, wherein the limited duration of time is less than about fifteen seconds.

6. The pet door system of claim 1, wherein a plurality of open modes are available per day.

7. The pet door system of claim 1, wherein once the pet has passed through the pet door during an open mode, the pet door can no longer be transgressed by the pet until a next open mode.

8. The pet door system of claim 1, wherein the central processing unit is operationally linked to a smart phone or a computer, said computer or said smart phone having an application that allows programming of the central processing unit.

9. The pet door system of claim 8, further comprising a battery which powers the central processing unit.

10. The pet door system of claim 9, wherein a charge on said battery is indicated by the illumination of one or more lights.

11. The pet door system of claim 10, wherein at least three lights are present that indicate the charge on the battery.

12. The pet door system of claim 1, further comprising an override button that allows override of the pet door system, which has been programmed.

13. A pet door system that comprises a pet door, a central processing unit, at least one speaker, at least one battery charge indicator light, and an override button: wherein the central processing unit is programmed to control the pet door system so that passage through the pet door by a pet can only be made during one or more open modes, with each open mode allowing passage by the pet through the pet door for a limited duration of time, said speaker emitting at least one sound each time the one or more open modes are available to the pet, said override button allowing the override of the programmed control of the pet door wherein the limited duration of time is less than about one minute.

14. The pet door system of claim 13, wherein the central processing unit is operationally linked to a smart phone or a computer, said computer or said smart phone having an application that allows programming of the central processing unit.

15. The pet door system of claim 14, wherein the central processing unit is controlled by a smart phone application.

16. The pet door system of claim 15, wherein said smart phone application alerts a pet owner that severe weather is soon coming to a location of the pet door system.

* * * * *